US010811806B2

(12) United States Patent
Trenkamp et al.

(10) Patent No.: US 10,811,806 B2
(45) Date of Patent: Oct. 20, 2020

(54) MODULAR CONNECTION MODULE, PLUG-IN CONNECTOR ASSEMBLY AND FIELD DEVICE

(71) Applicant: Buerkert Werke GmbH & Co. KG, Ingelfingen (DE)

(72) Inventors: Daniel Trenkamp, Ingelfingen (DE); Jan Westermann, Ingelfingen (DE); Dominik Stawarz, Ingelfingen (DE)

(73) Assignee: BUERKERT WERKE GMBH & CO. KG (DE)

( * ) Notice: Subject to any disclaimer, the term of this patent is extended or adjusted under 35 U.S.C. 154(b) by 0 days.

(21) Appl. No.: 16/382,275

(22) Filed: Apr. 12, 2019

(65) Prior Publication Data

US 2019/0319394 A1 Oct. 17, 2019

(30) Foreign Application Priority Data

Apr. 12, 2018 (DE) ..... 10 2018 108 740

(51) Int. Cl.
*H01R 13/60* (2006.01)
*H01R 13/514* (2006.01)
*H01R 31/06* (2006.01)

(52) U.S. Cl.
CPC ..... *H01R 13/514* (2013.01); *H01R 31/06* (2013.01)

(58) Field of Classification Search
CPC .... H01R 13/514; H01R 31/06; H01R 13/518; H01R 24/76; H01R 24/66; H01R 27/02; H01R 24/86
See application file for complete search history.

(56) References Cited

U.S. PATENT DOCUMENTS

| | | | | |
|---|---|---|---|---|
| 6,511,337 | B1 * | 1/2003 | Fandrey | H05K 7/1462 439/206 |
| 7,404,735 | B2 | 7/2008 | Reker et al. | |
| 7,470,146 | B1 * | 12/2008 | Chen | H01R 24/58 439/541.5 |
| 8,172,583 | B2 | 5/2012 | Friedrich | |
| 9,570,868 | B2 | 2/2017 | Kleinke | |
| 2006/0193589 | A1 | 8/2006 | Reker et al. | |
| 2006/0240682 | A1 * | 10/2006 | Kuhbauch | F15B 13/0817 439/1 |
| 2009/0145656 | A1 * | 6/2009 | Tschudin | G01D 11/245 174/521 |

(Continued)

FOREIGN PATENT DOCUMENTS

| | | | |
|---|---|---|---|
| DE | 202005003124 | U1 | 7/2006 |
| DE | 102008038588 | A1 | 2/2010 |
| DE | 102013105518 | A1 | 12/2014 |

*Primary Examiner* — Abdullah A Riyami
*Assistant Examiner* — Nelson R. Burgos-Guntin
(74) *Attorney, Agent, or Firm* — Dilworth IP, LLC

(57) ABSTRACT

A modular connection module for a field device is described, comprising an adapter board with at least one multipolar, universal contact area for the connection of plug-in connectors as well as a central electrical output interface for the electrical connection of the modular connection module to the field device. The multipolar, universal contact area is formed to accommodate plug-in connectors with different connection diagrams, wherein the connection diagram is defined by the arrangement of the contacts of the plug-in connector. Further, a plug-in connector assembly and a field device are described.

21 Claims, 4 Drawing Sheets

(56) References Cited

U.S. PATENT DOCUMENTS

| | | | | |
|---|---|---|---|---|
| 2009/0156028 | A1* | 6/2009 | Bumb, Jr. | H01R 4/26 439/91 |
| 2009/0239399 | A1* | 9/2009 | Azzola | H01H 71/08 439/119 |
| 2010/0114367 | A1* | 5/2010 | Barrett | G06F 19/3456 700/236 |
| 2011/0151690 | A1 | 6/2011 | Friedrich | |
| 2014/0265306 | A1* | 9/2014 | Fadell | G01L 19/003 285/120.1 |
| 2016/0118757 | A1 | 4/2016 | Kleinke | |
| 2018/0095174 | A1* | 4/2018 | Mertz | G01B 11/002 |
| 2018/0151977 | A1* | 5/2018 | Moser | H01R 13/527 |

* cited by examiner

MODULAR CONNECTION MODULE, PLUG-IN CONNECTOR ASSEMBLY AND FIELD DEVICE

FIELD OF THE DISCLOSURE

Embodiments of the present disclosure relate to a modular connection module for a field device, and a plug-in connector assembly. In addition, embodiments of the present disclosure relate to a field device.

BACKGROUND OF THE INVENTION

Field devices are known from the state of the art, for example valves, which have several connections in order to be able to accommodate different plug-in connectors which are necessary for the operation of the field device. Among others these are, for example, an analog port, an Ethernet port, a PROFINET port, a PROFIBUS connection, an IO-Link port, an AS-Interface and further connection variants.

In addition to the different types of connection, plug-in connectors are also provided which have a different connection diagram, which is defined by the arrangement of the contacts of the plug-in connector. For the corresponding plug-in connectors with different connection diagrams, corresponding connections must thus likewise be provided on the field device, whereby the number of connections provided increases further.

It has proved to be a disadvantage here that the space requirement for such an extensive variation of connections is very high, with the result that in particular in the case of smaller field devices only some of the connections usually provided can be provided.

Therefore, in the state of the art, the corresponding connections on the field device are usually matched to the need, whereby however the functionality of the field device is restricted, production costs are high and there is a considerable assembly effort. This is due, among other things, to the great variety of parts as a result of the different connections, whereby the production and the assembly are complex.

SUMMARY OF THE INVENTION

The object is to simplify the electrical connection of plug-in connectors to a field device in a cost-effective manner.

This object is achieved by a modular connection module for a field device for the modular connection of plug-in connectors to the field device. The modular connection module comprises an adapter board with at least one multipolar, universal contact area for the connection of plug-in connectors as well as a central electrical output interface for the electrical connection of the modular connection module to the field device. The multipolar, universal contact area is formed to accommodate plug-in connectors with different connection diagrams, wherein the connection diagram is defined by the arrangement of the contacts of the plug-in connector.

The basic idea is thus to provide a modular connection module for a field device which can be coupled to the field device in order to form an interface for several plug-in connectors, in particular different plug-in connectors. The modular connection module comprises at least one multipolar, universal contact area which can accommodate plug-in connectors which are formed differently with respect to the connection diagram. It is hereby possible that, over the one universal contact area, the connection of different multipin plug-in connectors is possible, for example plug-in connectors with a 4-, 5- or 8-pin connection diagram. A large number of possible connections is hereby covered, wherein the number of parts required is reduced, in particular is minimized, because of the modular connection module. The modular connection module thus represents a single interface, both from a mechanical and an electrical point of view, for the field device and the plug-in connectors.

Since the contact area is formed on the adapter board, the plug-in connectors are coupled to the adapter board directly via their contacts.

In other words, the multipolar, universal contact area is designed geometrically such that different plug-in connectors, thus plug-in connectors with a different connection diagram, can be coupled to the contact area.

For example, the modular connection module or the multipolar, universal contact area is formed to accommodate M8 or M12 circular connectors, which in particular have a 4-, 5- or 8-pin connection diagram.

In general, the connection module can also have several multipolar, universal contact areas. The variety of connections of the connection module hereby increases accordingly.

One aspect provides that the modular connection module is formed as a plug-in module, such that the modular connection module can be plugged into a holding fixture in the field device. A simple assembly of the modular connection module on the field device hereby results as it can be plugged into or onto the field device in order to couple it to the field device (mechanically and electrically). The electrical coupling to the field device can be effected via the central electrical output interface. In addition, it can be provided that the connection module is fixed to the field device such that an unintentional disassembly of the connection module can be effectively prevented.

A further aspect provides that the at least one contact area is formed to accommodate plug-in connectors with different numbers of pins. In this respect, 4-, 5- or 8-pin plug-in connectors can be connected to the same contact area since the corresponding contact area is formed multipolar and universal. The connection diagram can thus differ not only in the arrangement of the contacts of the plug-in connector but also in the number of contacts used. A large number of different plug-in connectors can hereby be connected to a single multipolar, universal contact area.

According to a further aspect, the at least one contact area comprises a centrally arranged contact element as well as several contact surfaces arranged around the central contact element. A corresponding contact diagram of the multipolar, universal contact area formed by the contact element and the contact surfaces hereby results, which can accommodate different connection diagrams of the plug-in connectors.

In general, the contact element and the contact surfaces arranged around it can be formed in the same way, for example as surface contacts, socket contacts, pin contacts or in another suitable way. The contact element and the contact surfaces can generally be referred to as contact points of the contact area.

For example, seven contact surfaces are provided, which are arranged accordingly around the centrally arranged contact element, with the result that the corresponding contact area has eight contact points which can be occupied at most.

In particular, the contact surfaces are arranged at least in areas on a segment of a circle which runs around the centrally arranged contact element. A substantially concentric arrangement of the contact surfaces in relation to the centrally arranged contact element results. The geometric centres of the respective contact surfaces can, however, deviate from the common segment of a circle on which the contact surfaces lie at least in areas. This means that the segment of a circle merely intersects the corresponding contact surfaces. However, the intersection point need not necessarily lie on the geometric centre of the respective contact surfaces. Although this can be the case.

A further aspect provides that at least one contact surface has an elongated shape compared with the centrally arranged contact element. The elongated shape ensures that plug-in connectors with different connection diagrams can be accommodated in a simple manner as a contact of the plug-in connector assigned to the elongated contact surface can be in contact with different sections or areas of the elongated contact surface in order to produce the electrical contact. For example, a contact of a first plug-in connector is assigned to a first section or a first area of the elongated contact surface, whereas a contact of a second plug-in connector (with a different connection diagram) is assigned to a second section or a second area of the elongated contact surface. The two sections or areas can partially overlap.

In particular, pairs of contact surfaces each have an elongated shape with the result that two, four etc. contact surfaces of the contact area have a substantially elongated shape compared with the centrally arranged contact element.

Several contact surfaces can have an elongated shape, wherein these contact surfaces extend in different directions. A substantially symmetrical connection diagram of the corresponding contact area hereby results, wherein the axis of symmetry can run through the centrally arranged contact element.

Plug-in connectors with different connection diagrams can thus be connected in a simple manner to one contact area, as the contact diagram of the corresponding contact area does not shift in only one direction, as would be the case if the elongated contact surfaces were to extend in the same direction.

A further aspect provides that the contact surfaces have different distances from each other. The different distances ensure that plug-in connectors with different connection diagrams can be connected to a correspondingly formed contact area. In particular, electrostatic discharges are taken into consideration here.

At least one of the contact surfaces can have a surface area which is larger than an assigned contact of the plug-in connector. It is hereby guaranteed that plug-in connectors with different connection diagrams, thus a different arrangement of the contacts, can be connected to the same contact area.

For example, the at least one contact area is formed on a surface of the adapter board and/or at the edge of recesses of the adapter board. Therefore, the contact area, in particular the contact surfaces and/or the centrally arranged contact element, can be coupled, in particular soldered, to the contacts of the corresponding plug-in connector in a simple manner by means of an SMT (surface-mount technology) method or a THR (through-hole reflow) process.

In the SMT method, the contact area formed on the surface of the adapter board, which is formed substantially flat, is connected to the contacts of the plug-in connector.

In the THR process, in contrast, the contacts of the plug-in connector are coupled to the contact surfaces provided in the recesses in the adapter board and/or to the contact element provided in the recess, thus to the edges of the recesses. The contacts of the plug-in connector formed as contact pins can protrude into the recesses in order to electrically contact the plug-in connector with the multipolar, universal contact area.

The substantially elongated shape can likewise be provided in the case of the recesses, with the result that the corresponding recesses are not round, but elongated, droplet-shaped or cuneiform. For example, plug-in connectors with contact pins which can have different diameters can hereby be accommodated.

According to an embodiment, a connection plate is provided which is arranged in front of the adapter board in the connection direction of the plug-in connectors. This means that, when the plug-in connectors are fastened to the modular connection module, they must first pass through the connection plate before they can come into contact with the adapter board. For example, the corresponding plug-in connectors protrude through the connection plate when they electrically contact the adapter board. For this, cut-outs in the connection plate are provided, through which the plug-in connectors protrude at least partially in order to be able to electrically contact the adapter board.

In general, the connection plate can be mechanically coupled to the adapter board, for example by way of fastening elements such as screws, such that one structural unit results.

The connection plate can be set up to form an outer wall of the casing. The connection plate can thus, when the modular connection module is mounted on the field device (mounted state), form part of the casing of the field device, such that a closed casing results. This is the case, for example, when the modular connection module is inserted into a holding fixture of the field device, with the result that the adapter board is completely accommodated in the field device. The connection plate which is upstream of the adapter board in the plug-in direction of the plug-in connector then ensures that the casing of the field device, thus the holding fixture of the field device, is closed by the connection plate, in particular is sealed.

The output interface can be electrically connected to the at least one contact area. It is hereby ensured that the signals travelling via the plug-in connectors can be relayed from the contact area to the central electrical output interface, from where the electrical signals are relayed to a control device of the field device. Likewise, the signals can be relayed in the reverse direction from the control device of the field device via the modular connection module and the plug-in connectors to the correspondingly connected components.

Alternatively or in addition, the output interface is formed by a plug-in connector. If the modular connection module is a plug-in module, the electrical contact of the modular connection module with the field device can be produced in a simple manner by plugging the central electrical output interface into a corresponding input interface of the field device. This can be implemented in a simple manner by way of a corresponding plug-in connector.

A further aspect provides that the several multipolar, universal contact areas are each formed identical. The modular connection module thus has several identical contact areas which are each formed for the connection of several plug-in connectors with different connection diagrams. In spite of the identical contact areas it is thus possible to connect different plug-in connectors, in particular plug-in connectors with different connection diagrams, to the modular connection module.

Furthermore, the object is achieved by a plug-in connector assembly for a field device, comprising a modular connection module of the type named above as well as at least one plug-in connector, wherein the plug-in connector is connected to the multipolar, universal contact area of the connection module. The advantages named above thus result in an analogous manner for the plug-in connector assembly, in which the corresponding plug-in connector is coupled to the contact area.

If the connection module has several contact areas, the plug-in connector assembly can comprise several plug-in connectors which each have a different connection diagram. The plug-in connectors can each selectively be coupled to one of the several contact areas as the contact areas are multipolar and universal.

The plug-in connector can be conductively connected to the contact area with the result that an electrical conduction between the plug-in connector and the modular connection module is guaranteed. Signals can thus be exchanged between the central electrical output interface and the plug-in connector, in particular via a component coupled to the plug-in connector.

For example, the plug-in connector is soldered to the contact area, whereby, in addition to the electrical connection, a mechanical connection also results.

Alternatively or in addition, the plug-in connector is plugged into the adapter board in a form-fitting manner, in particular into the multipolar, universal contact area. A mechanical connection of the plug-in connector to the modular connection module also results hereby.

Further, the object is achieved by a field device with a casing and a modular connection module of the type named above or a plug-in connector assembly of the type named above, wherein the modular connection module is fastened to the casing. Signals can thus be passed on from the field device, in particular an internal control device of the field device, to the corresponding components coupled on via the plug-in connectors, or correspondingly be received. For this, the control device of the field device can transmit or receive the corresponding signals.

For example, the casing has a holding fixture for the connection module, such that the casing is formed closed by the connection module when the modular connection module is fastened to the casing, in particular is plugged into the holding fixture of the casing.

BRIEF DESCRIPTION OF THE DRAWINGS

Further advantages and properties of the present disclosure result from the following description and the drawings, to which reference is made. There are shown in.

DETAILED DESCRIPTION OF THE INVENTION

Figure 1:
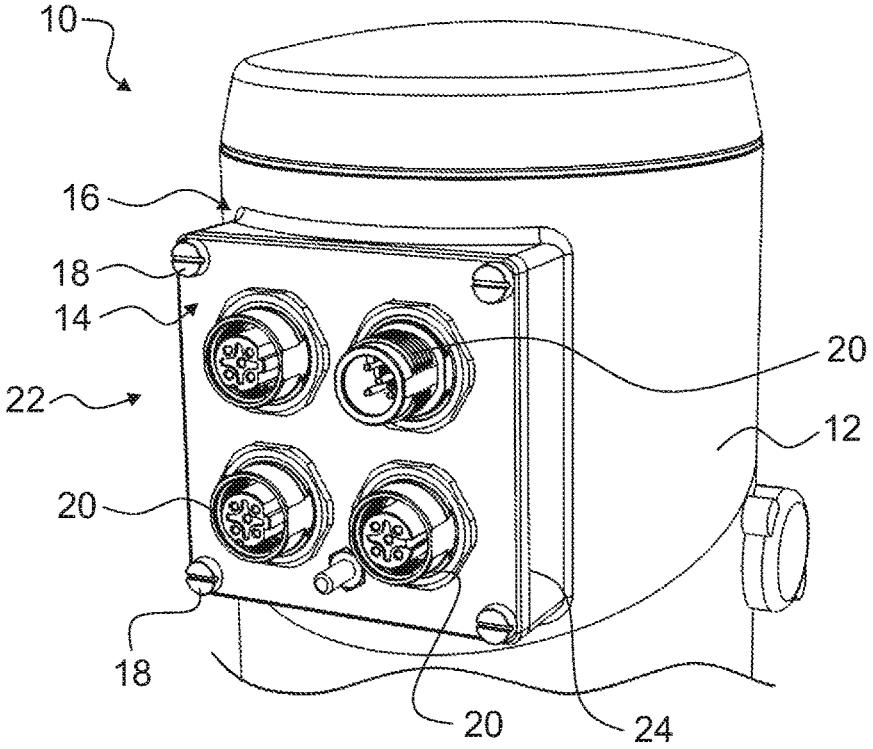
FIG. 1 a partial perspective view of a field device according to the present disclosure with a modular connection module according to the present disclosure, FIG. 2 a perspective view of a connection module according to the present disclosure before it is coupled to a field device, FIG. 3 a perspective view of a plug-in connector assembly according to the present disclosure in the uncoupled state, FIG. 4 a detail view of FIG. 3, FIG. 5 a schematic representation of a multipolar, universal contact area which is occupied in three different cases, FIG. 6 a perspective view of a plug-in connector assembly according to the present disclosure, FIG. 7 a further perspective view of the plug-in connector assembly according to the present disclosure from FIG. 6, FIG. 8 a perspective view of a plug-in connector, which is used in the case of the plug-in connector assembly according to the present disclosure according to FIGS. 6 and 7, and FIG. 9 a schematic representation of a multipolar, universal contact area which is occupied in three different cases.

In FIG. 1, a field device 10 is partially shown, which comprises a casing 12 and a modular connection module 14 arranged on the casing 12.

The casing 12 has a holding fixture 16, into which the connection module 14 is partially plugged, such that the casing 12 of the field device 10 is formed closed towards the outside.

The modular connection module 14 is further mechanically coupled to the casing 12 by way of fastening means 18, in particular screws, with the result that it is correspondingly fastened or fixed to the field device 10.

In the embodiment shown, four plug-in connectors 20 are connected to the modular connection module 14, which are coupled to the modular connection module 14 both electrically and mechanically, as is explained further below.

It already emerges from FIG. 1 that the plug-in connectors 20 can be formed differently as it involves sockets (also coupling or female connectors) and plugs (also male connectors). External cables can be connected to the respective plug-in connectors 20 via appropriately correspondingly formed plug-in connectors, via which the field device 10 can be electrically connected to corresponding components.

In the embodiment shown, the plug-in connectors 20 are M8 and M12 circular connectors, which have a multi-pin form, as is explained further below. Alternatively or in addition, the coding (A, B, K, L or D) of the plug-in connectors 20 can vary.

The modular connection module 14 forms, together with the fitted plug-in connectors 20, a plug-in connector assembly 22, which is correspondingly connected to the field device 10.

Figure 2:
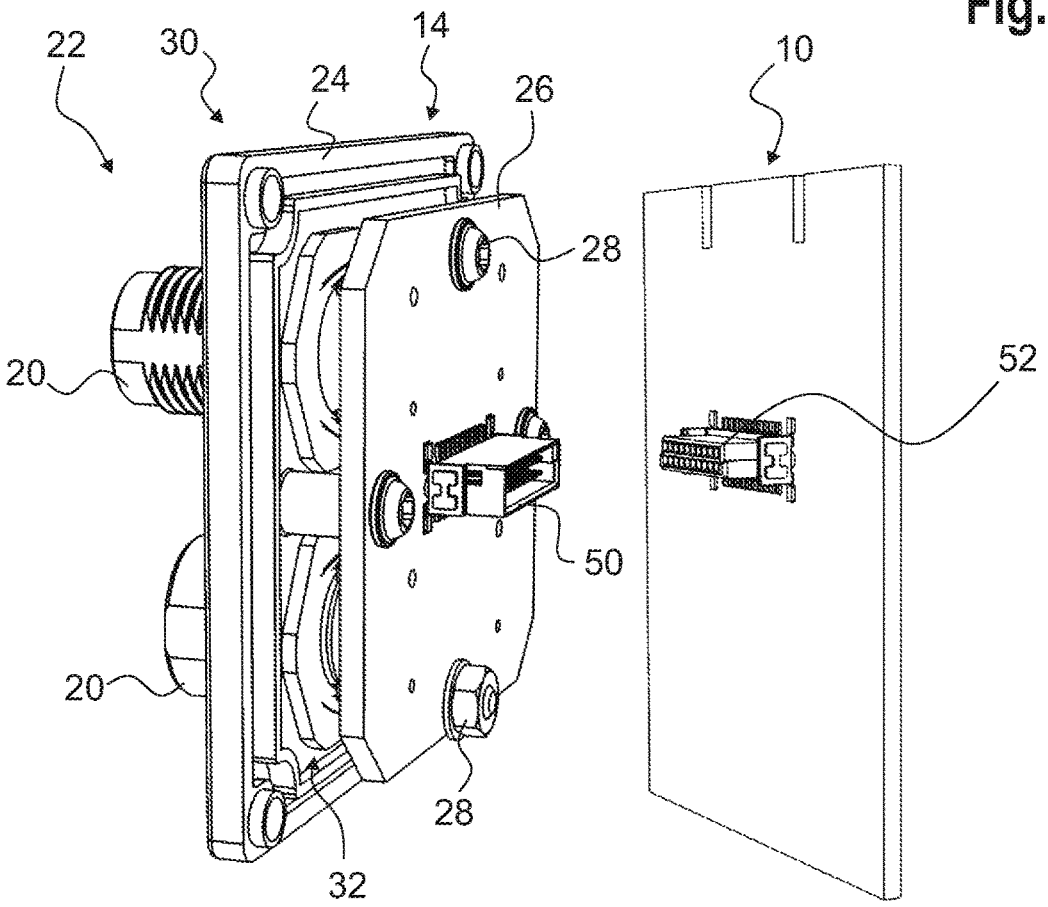

In FIG. 2, the plug-in connector assembly 22 is shown in the unmounted state, from which it emerges that the modular connection module 14 has a connection plate 24, which is mechanically coupled to an adapter board 26 by way of fastening elements 28, for example screws, with the result that one structural unit 30 is formed.

The connection plate 24 is arranged in front of the adapter board 26 in the plug-in direction or connection direction of the plug-in connectors 20, wherein the connection plate 24 can have cut-outs 32 corresponding to the number of plug-in connectors 20, through which the plug-in connectors 20 protrude in order to electrically contact the adapter board 26 directly.

Figure 3:
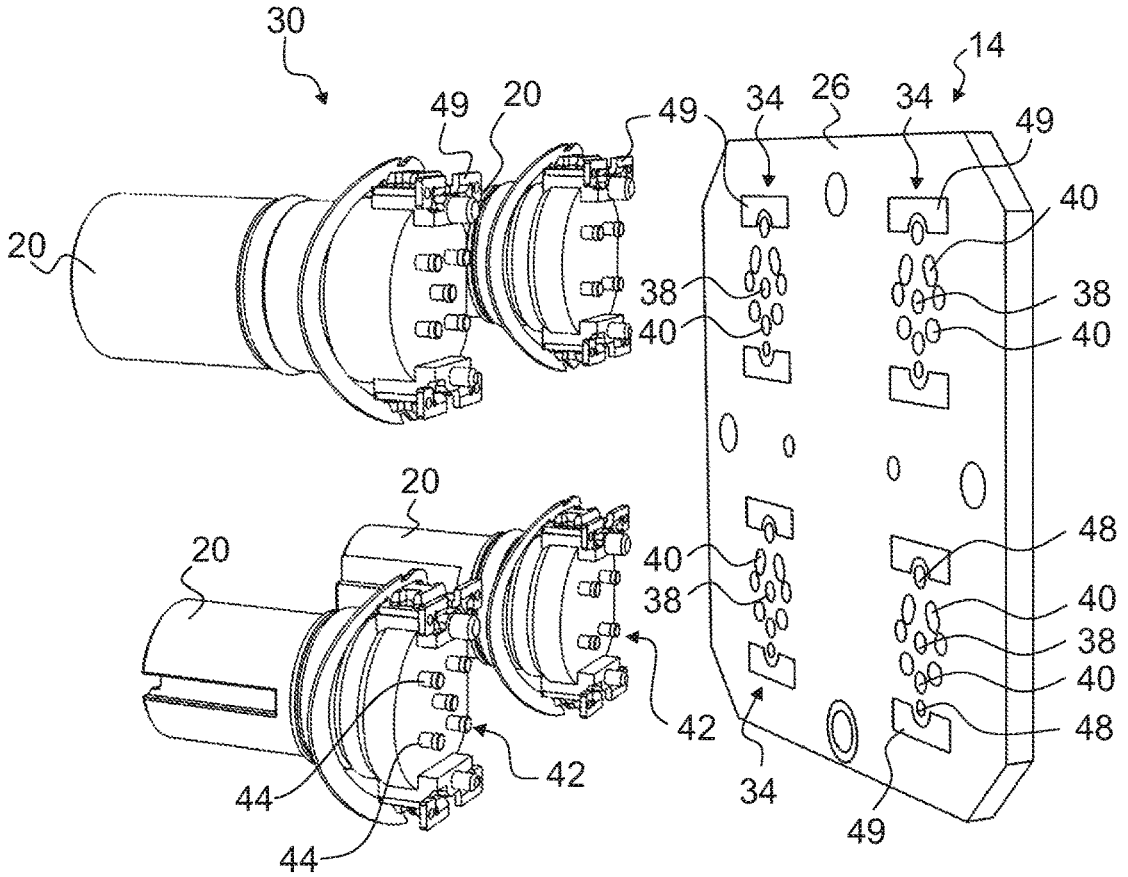

For this, the adapter board 26 comprises multipolar, universal contact areas 34, as emerges from FIG. 3, in which the plug-in connector assembly 22 is shown in the unmounted state. For the sake of better clarity, the connection plate 24 is not shown in FIG. 3.

However, an adapter board 26 which has only one multipolar, universal contact area 34 can also be provided.

The contact areas 34 each have a centrally arranged contact element 38, around which several contact surfaces 40 are arranged. The contact surfaces 40 and the contact element 38 can be formed similarly.

In the embodiment shown, the contact points, thus the contact element 38 and the contact surfaces 40, are formed on a surface of the adapter board 26, such that they are formed substantially flat.

The plug-in connectors 20 can then be coupled, in particular soldered, to the corresponding contact area 34 in a simple manner using a so-called SMT (surface-mount technology) method.

As already emerges from FIG. 3, the contact surfaces 40 are at least in some cases formed elongated, as the respective contact surfaces 40 have an elongated shape compared with the centrally arranged contact element 38. These contact surfaces 40 extend in different directions.

The respective contact areas 34, which serve for the connection of the plug-in connectors 20, are all formed identical in the embodiment shown.

Given that the contact areas 34 are set up to accommodate different plug-in connectors 20, different plug-in connectors 20 can be correspondingly contacted. This already emerges from FIG. 3 as the plug-in connectors 20 shown there have different connection diagrams 42, namely a 4-pin and 5-pin connection diagram 42. The respective connection diagram 42 is defined by the arrangement of the contacts 44 of the plug-in connectors 20, which can also be referred to as contact pins or pins.

Figure 4:
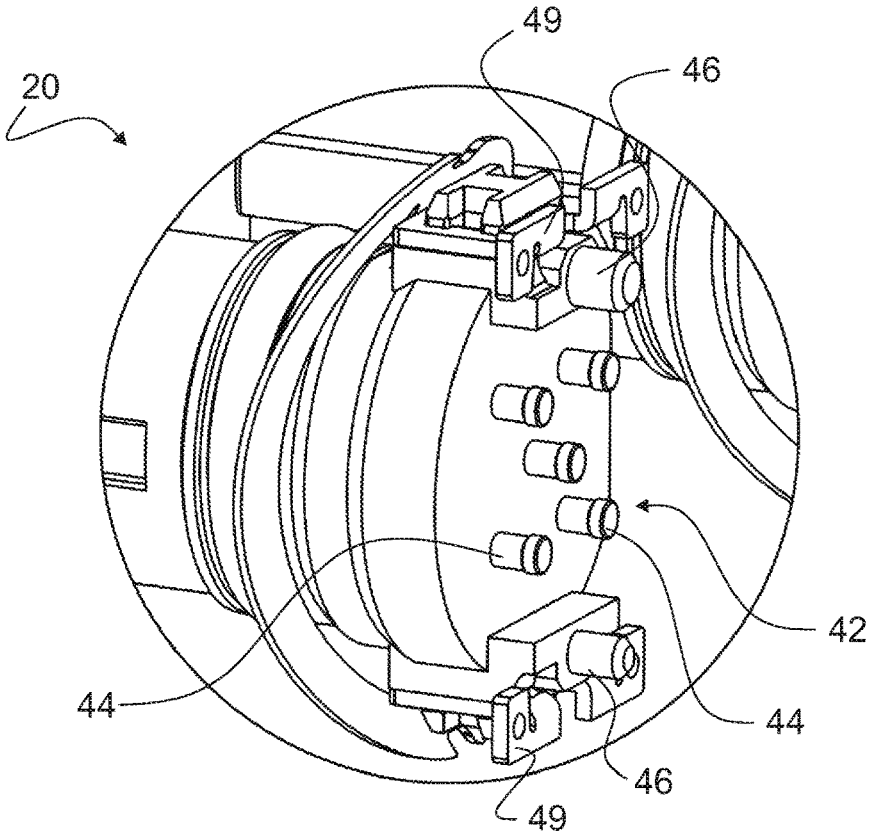

In FIG. 4, a 5-pin plug-in connector 20 is shown in detail, in particular the connection diagram 42 thereof.

From FIGS. 3 and 4 it further emerges that, independently of the number of pins of the connection diagram 42, thus the number of contacts 44, the respective plug-in connectors 20 have at least one guide pin 46, via which the plug-in connectors 20 can be plugged into corresponding openings 48 of the contact areas 34 in order to guarantee a form-fitting coupling of the plug-in connectors 20 to the adapter board 26 of the modular connection module 14.

The mechanical connection of the plug-in connectors 20 can alternatively or additionally be formed in that the plug-in connectors 20 are soldered onto the adapter board 26.

In addition to the contact points, thus the contact surfaces 40 and the contact element 38, at least one earth contact 49 can be provided both on the plug-in connectors 20 and in the contact areas 34.

The different contact areas 34, which are electrically coupled to the plug-in connectors 20, are also electrically connected to a central electrical output interface 50, which is formed for the electrical connection of the plug-in connector assembly 22 or of the modular connection module 14 to the field device 10, as emerges from FIG. 2.

For this, the field device 10 can have an input interface 52, which is formed correspondingly to the output interface 50.

The output interface 50 can be a plug-in connector, such that the connection module 14 or the plug-in connector assembly 22 can be electrically contacted to the field device 10 in a simple manner by plugging the output interface 50 into the corresponding input interface 52 on the field device 10.

Figure 5:
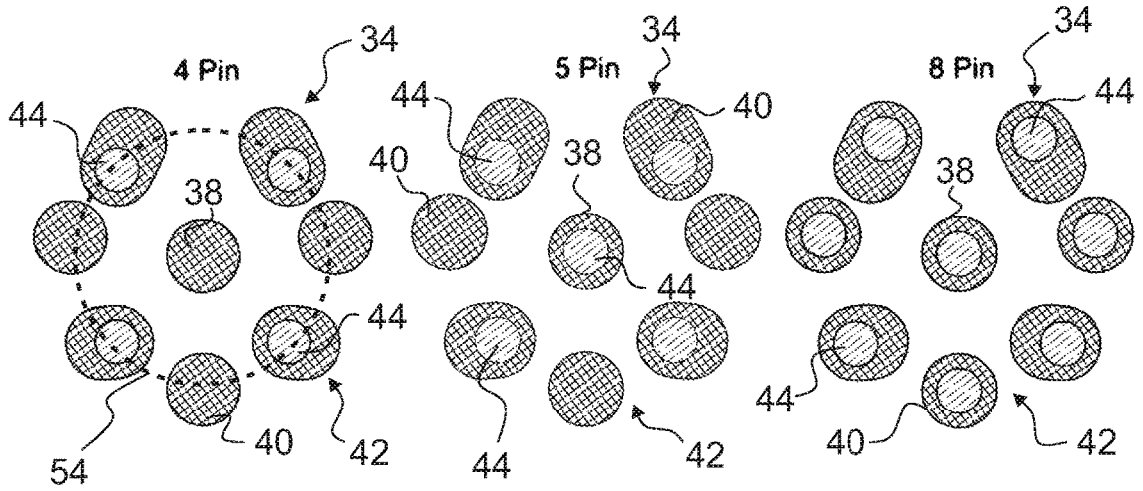

In FIG. 5, one of the several multipolar, universal contact areas 34 is shown in detail for three different connection scenarios, in which the same contact area 34 is occupied by different plug-in connectors 20, which each have a different connection diagram 42, namely a 4-, 5- or 8-pin connection diagram 42.

It also becomes clear from this that the contact areas 34 are each formed to accommodate plug-in connectors 20 with different numbers of pins.

It emerges from FIG. 5 that the contact surfaces 40 are arranged at least in areas on a segment of a circle 54, which in FIG. 5 is shown with a dashed line for the first case (4-pin connection diagram 42). The contact surfaces 40 do not necessarily lie with their geometric centre on the segment of a circle 54. Although this can be the case.

Furthermore, it becomes clear that several of the contact surfaces 40 have an elongated shape compared with the centrally arranged contact element 38, wherein the contact surfaces 40 each have an elongated shape in pairs.

Further, the elongated contact surfaces 40 can extend in different directions, as is clearly depicted in FIG. 5 for the two upper contact surfaces.

Other contact surfaces 40 can also be round, in particular like the centrally arranged contact element 38.

The contact surfaces 40 each have different distances from each other. The corresponding distances of the contact surfaces 40 from each other are also related, among other things, to their shape.

In spite of the different shape and/or distances of the contact surfaces 40, the multipolar, universal contact area 34 is formed substantially symmetrical, namely mirror-symmetrical with respect to a mirror axis which runs vertically through the centrally arranged contact element 38.

Furthermore, it emerges from FIG. 5 that the plug-in connectors 20 with the different connection diagrams 42, thus the differently arranged contacts 44, only partially occupy the contact surfaces 40 for the 4- or 5-pin case. In the 4-pin case (on the left) the centrally arranged contact element 38 is also not occupied.

A comparison of the 5-pin case (in the centre) with the 4-pin case (on the left) shows that the connection diagram 42 of the respective plug-in connector 20 differs to the effect that, in the 5-pin connection diagram 42, the centrally arranged contact element 38 is occupied by a contact 44 of the plug-in connector 20.

Further, a comparison of the 8-pin connection diagram 42 (on the right) with the 4- or 5-pin connection diagram 42 shows that the contacts 44 contact the elongated contact surfaces 40 in a different area of the corresponding contact surface 40, in particular the upper pair of elongated contact surfaces 40.

It becomes clear from this that the multipolar, universal contact areas 34 are formed to accommodate plug-in connectors 20 with different connection diagrams 42, whereby a correspondingly convenient and manageable possibility is created to couple different plug-in connectors 20 to the field device 10. This is ensured by way of the modular connection module 14 with the multipolar, universal contact areas 34.

Figure 6:
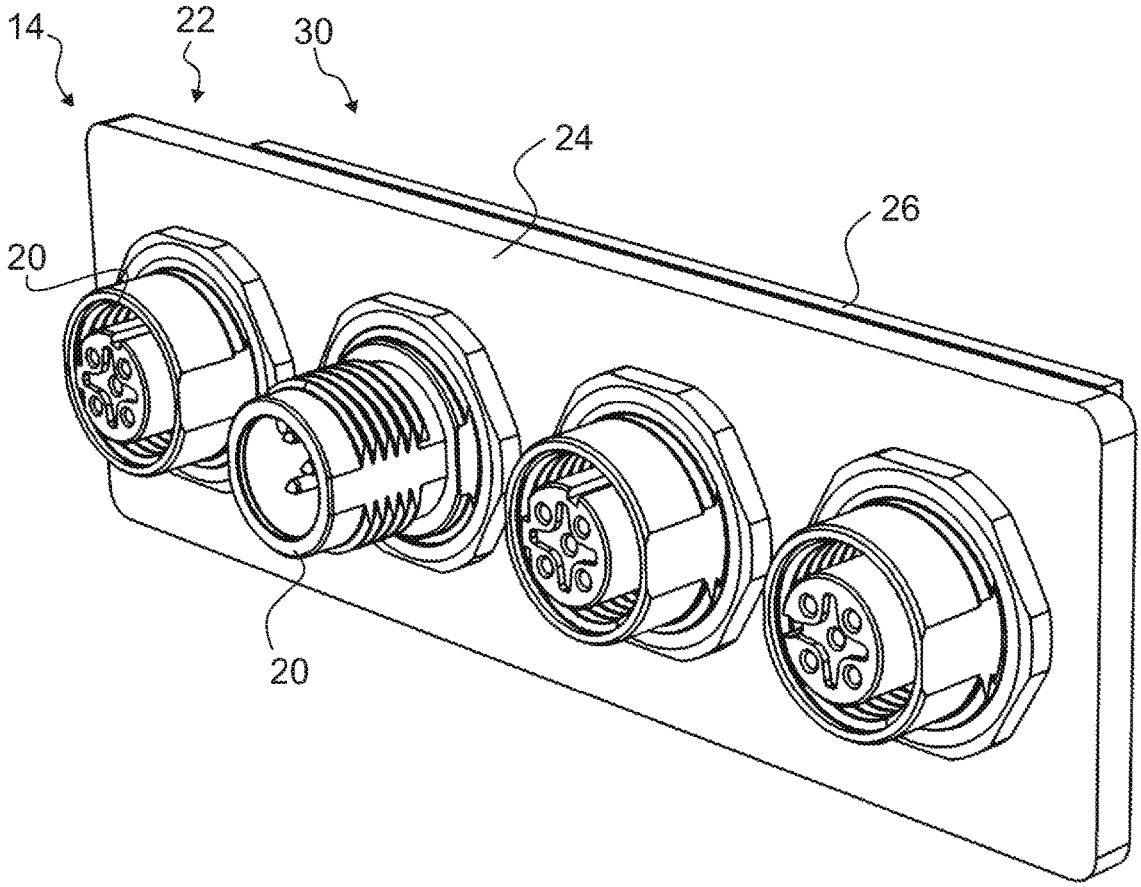
Figure 7:
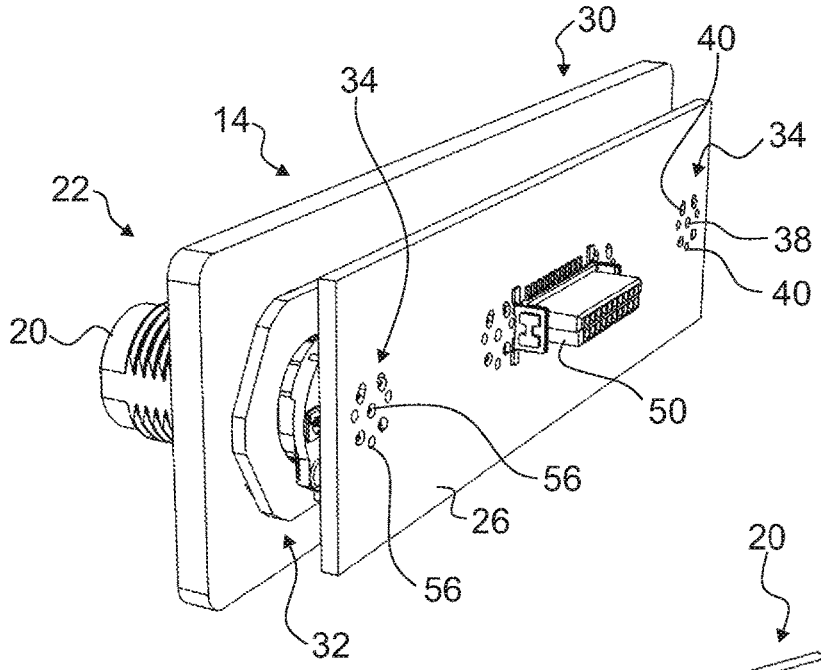

In FIGS. 6 and 7, a further embodiment of a plug-in connector assembly 22 is shown, in which four plug-in connectors 20 are provided which are arranged in a row on the modular connection module 14. In comparison, the four plug-in connectors 20 in the previous embodiment were arranged matrix-like, namely in a 2×2 matrix.

As already explained with respect to the embodiment according to FIGS. 1 to 5, the plug-in connectors 20 can be formed differently, wherein they extend through the connection plate 24 to the adapter board 26 arranged behind it, which emerges in particular from FIG. 7.

In contrast to the embodiment shown in FIGS. 1 to 5, in this embodiment the modular connection module 14 has multipolar, universal contact areas 34 which comprise several recesses 56 in the adapter board 26, at the edge 58 of which the respective contact surfaces 40 or the centrally arranged contact element 38 are or is formed, thus the respective contact points of the contact areas 34.

The plug-in connectors 20, in particular the contacts 44 thereof, can be coupled, in particular soldered, to the contact areas 34 formed in such a way in a simple manner by way of a so-called THR (through-hole reflow) process.

Figure 8:
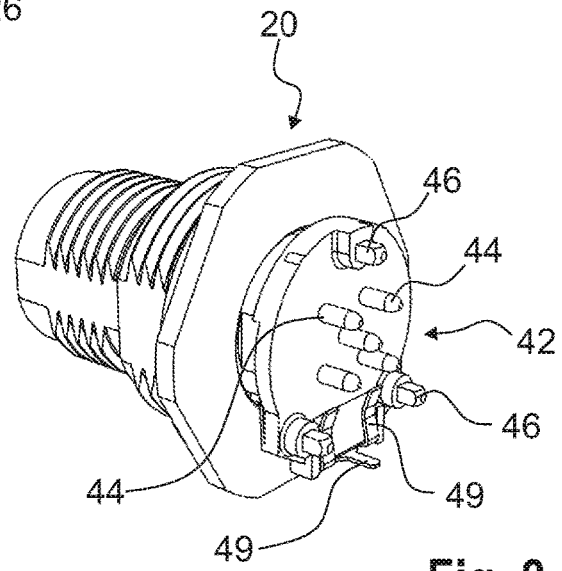

In FIG. 8, a plug-in connector 20 is shown which can be used in the case of the modular connection module 14 of FIGS. 6 and 7. The plug-in connector 20 has several contacts 44 which are formed to protrude into the recesses 56 in order to contact the edges 58 of the recesses 56. The edges 58 represent the contact points, thus the contact element 38 as well as the contact surfaces 40, such that an electrical connection is produced between the adapter board 26 and the plug-in connector 20.

Here, the earth contact 49 of the plug-in connector 20 can be formed pin-shaped and/or by spring elements.

Figure 9:
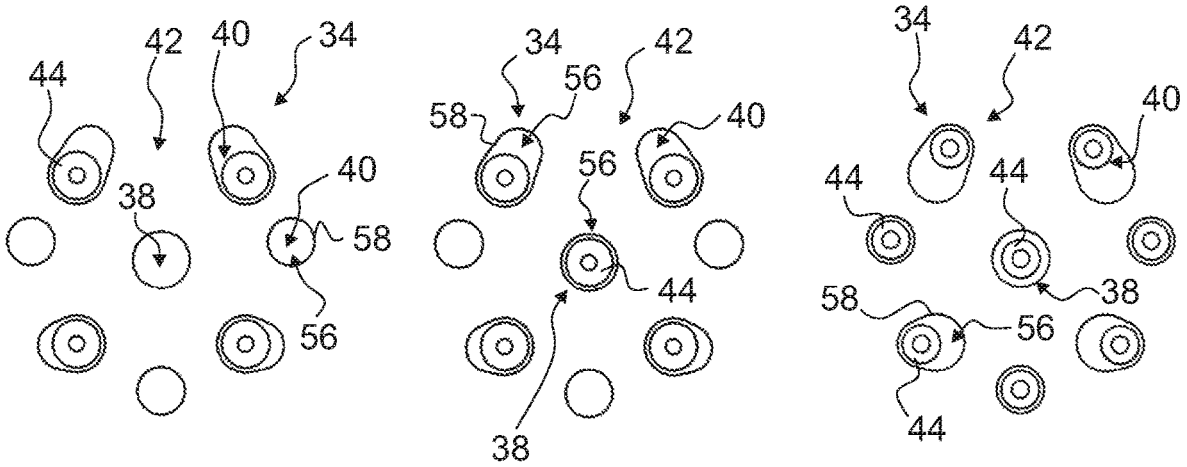

FIG. 9 shows, in a manner analogous to FIG. 5, how the plug-in connectors 20 with different connection diagrams 42 contact the multipolar, universal contact areas 34 of the modular connection module 14 shown in FIGS. 6 and 7.

Like the contact surfaces 40 in the embodiment shown in FIG. 5, the recesses 56 in some cases have an elongated shape.

Moreover, the recesses 56 can be formed droplet-shaped or cuneiform such that the distance between two opposite edges 58 of a recess 56 varies. It is hereby possible that contacts 44 of the plug-in connector 20 can be introduced into the recesses 56 which have different diameters, wherein the corresponding contacts 44 nevertheless contact opposite edges 58 simultaneously in order to guarantee a good electrical connection. For this, reference is made in particular to the contacting of the plug-in connector 20 with the 8-pin connection diagram 42 (on the right) and the contacting of the plug-in connector 20 with the 4- or 5-pin connection diagram 42 (on the left and in the centre).

In general, two to ten, preferably two to five, universal contact areas 34 can be formed on the respective adapter board 26, with the result that a corresponding number of plug-in connectors 20 can be coupled to the modular connection module 14 in order to form the respective plug-in connector assembly 22.

As emerges from the figures, the plug-in connectors 20 can each have contacts 44, which are formed as contact pins or pins, in order to correspondingly contact the contact areas 34, wherein the contact areas 34 can be provided flat on the surface of the adapter board 26 or in corresponding recesses 56 of the adapter board 26.

The contact areas 34 are generally formed such that plug-in connectors 20 with partially overlapping connection diagrams 42 can be connected to one and the same contact area 34.

For example, at least one of the contact surfaces 40 of a contact area 34 is formed larger than the assigned contact 44 of the plug-in connector 20, for example 1.5 to 5 times as large, in particular 2 to 3 times as large.

In general, a simple use of plug-in connectors 20 on a field device 10 as well as the corresponding connection of cables to the field device 10 is thus guaranteed.

The field device 10 can be e.g. a valve or a control head for a valve or a control head for a sensor.

The invention claimed is:

1. A modular connection module for a field device for the modular connection of plug-in connectors to the field device, the modular connection module comprising an adapter board with at least one multipolar, universal contact area for the connection of plug-in connectors as well as a central electrical output interface for the electrical connection of the modular connection module to the field device, wherein the multipolar, universal contact area has several and separate contact points, wherein the multipolar, universal contact area is formed to accommodate plug-in connectors with different connection diagrams, the connection diagram being defined by the arrangement of the contacts of the plug-in connector, and wherein the central electrical output interface is electrically connected to the several and separate contact points.

2. The modular connection module according to claim 1, wherein the modular connection module is formed as a plug-in module, such that the modular connection module can be plugged into a holding fixture in the field device.

3. The modular connection module according to claim 1, wherein the at least one contact area is formed to accommodate plug-in connectors with different numbers of pins.

4. The modular connection module according to claim 1, wherein the at least one contact area comprises a centrally arranged contact element as well as several contact surfaces arranged around the central contact element.

5. The modular connection module according to claim 4, wherein the contact surfaces are arranged at least in areas on a segment of a circle which runs around the centrally arranged contact element.

6. The modular connection module according to claim 4, wherein at least one contact surface has an elongated shape compared with the centrally arranged contact element.

7. The modular connection module according to claim 6, wherein several contact surfaces have an elongated shape, wherein these contact surfaces extend in different directions.

8. The modular connection module according to claim 4, wherein the contact surfaces have different distances from each other.

9. The modular connection module according to claim 4, wherein at least one of the contact surfaces has a surface area which is larger than an assigned contact of the plug-in connector.

10. The modular connection module according to claim 1, wherein the at least one contact area is formed on a surface of the adapter board and/or at the edge of recesses of the adapter board.

11. The modular connection module according to claim 1, wherein a connection plate is provided which is arranged in front of the adapter board in the connection direction of the plug-in connector.

12. The modular connection module according to claim 11, wherein the connection plate is set up to form an outer wall of a casing.

13. The modular connection module according to claim 1, wherein the output interface is electrically connected to the at least one contact area and/or is formed by a plug-in connector.

14. The modular connection module according to claim 1, wherein several multipolar, universal contact areas are provided.

15. The modular connection module according to claim 14, wherein the contact areas are each formed identically.

16. A plug-in connector assembly for a field device, comprising a modular connection module according to claim 1 as well as at least one plug-in connector, wherein the plug-in connector is connected to the multipolar, universal contact area of the modular connection module.

17. The plug-in connector assembly according to claim 16, wherein the plug-in connector is conductively connected to the contact area.

18. The plug-in connector assembly according to claim 16, wherein the plug-in connector is soldered to the contact area and/or plugged into the adapter board in a form-fitting manner.

19. A field device with a casing and a modular connection module according to claim 1 wherein the modular connection module is fastened to the casing.

20. The field device according to claim 19, wherein the casing has a holding fixture for the connection module, such that the casing is formed closed by the connection module.

21. The field device according to claim 19, wherein the modular connection module further comprises at least one plug-in connector connected to the multipolar, universal contact area of the modular connection module.

* * * * *